US008110770B2

(12) United States Patent
Ichikawa et al.

(10) Patent No.: US 8,110,770 B2
(45) Date of Patent: Feb. 7, 2012

(54) VACUUM CIRCUIT BREAKER OF TANK TYPE

(75) Inventors: Hiroki Ichikawa, Gamagori (JP); Kiyohito Katsumata, Numazu (JP); Yukihiro Takeshita, Numazu (JP); Kazuhiro Nagatake, Numazu (JP)

(73) Assignee: Japan AE Power Systems Corporation, Tokyo (JP)

( * ) Notice: Subject to any disclaimer, the term of this patent is extended or adjusted under 35 U.S.C. 154(b) by 744 days.

(21) Appl. No.: 12/280,112

(22) PCT Filed: Mar. 29, 2007

(86) PCT No.: PCT/JP2007/056843

§ 371 (c)(1),
(2), (4) Date: Aug. 20, 2008

(87) PCT Pub. No.: WO2007/132598

PCT Pub. Date: Nov. 22, 2007

(65) Prior Publication Data

US 2010/0288733 A1 Nov. 18, 2010

(30) Foreign Application Priority Data

May 11, 2006 (JP) ..... 2006-132142

(51) Int. Cl.
*H01H 33/666* (2006.01)

(52) U.S. Cl. ..... 218/134; 218/140; 218/154

(58) Field of Classification Search ..... 218/118, 218/120, 134, 139, 140, 153–155, 3, 7, 10, 218/14

See application file for complete search history.

(56) References Cited

U.S. PATENT DOCUMENTS 3,735,019 A * 5/1973 Hess et al. ..... 174/31 R
4,881,320 A * 11/1989 Kohle et al. ..... 29/841

FOREIGN PATENT DOCUMENTS

| | | | |
|---|---|---|---|
| JP | 56-170846 | U | 12/1981 |
| JP | 57-017528 | A | 1/1982 |
| JP | 60-141038 | U | 9/1985 |
| JP | 6-208820 | A | 7/1994 |
| JP | 2004-220922 | A | 8/2004 |
| JP | 2004-235122 | A | 8/2004 |
| JP | 2004-236455 | A | 8/2004 |
| JP | 2004-259449 | A | 9/2004 |

* cited by examiner

*Primary Examiner* — Renee Luebke
*Assistant Examiner* — Marina Fishman
(74) *Attorney, Agent, or Firm* — Foley & Lardner LLP

(57) ABSTRACT

A vacuum circuit breaker includes a movable-side conductor that is tubular and comprises an inside cavity. A movable side contact case includes a chamber which communicates with a space on a non-vacuum side of a bellows. The chamber is isolated from a space filled with insulating gas in a ground tank by a sealing device. The chamber communicates with an outside atmosphere through the inside cavity of the movable-side conductor.

3 Claims, 6 Drawing Sheets

VACUUM CIRCUIT BREAKER OF TANK TYPE

TECHNICAL FIELD

The present invention relates to a vacuum circuit breaker of a dead tank type for outdoor use in a substation to protect power equipment and for use of various other applications, and more specifically to an internal pressure structure in the tank.

BACKGROUND ART

FIG. 4 shows a vertical sectional front view of a dead tank type vacuum circuit breaker of earlier technology. A ground tank 2 is supported on a mount platform 1. An operation box 4 is fixed to one end of the ground tank 2 through a support plate 3. Operation box 4 includes therein an operation mechanism. An insulating support tube 5 is supported by the support plate 3 at one end in the horizontal direction in ground tank 2, and a support insulating member 6 is supported at the other end in the horizontal direction in ground tank 2. An electrically conductive movable-side contact case 8 is supported on the insulating support tube 5 through an insulating support member 7. A fixed-side contact case 9 is supported on the support insulating member 6. A vacuum interrupter 10 serving as a circuit breaking portion is supported horizontally at a movable-side end portion of the vacuum interrupter and a fixed-side end portion of the vacuum interrupter 10, respectively, by the movable-side and fixed-side contact cases 8 and 9. The operating mechanism in operation box 4 is connected with a movable lead 11 of vacuum interrupter 10 through a lever not shown in the figure and an insulating operating rod 12 extending through the insulating support tube 5 and the insulating support member 7. The movable lead 11 of vacuum interrupter 10 is inserted in the movable-side contact case 8, and electrically connected with the movable-side contact case 8. A fixed lead 13 of vacuum interrupter 10 is electrically connected with fixed-side contact box 9. Conductors 14 and 15 include lower ends electrically connected, respectively, with the contact cases 8 and 9, and extend upward in an inclined state, from the inside of ground tank 2. Conductors 14 and 15 are surrounded, respectively, by bushings 16 and 17, which are supported, respectively, by bushing current transformers 18 and 19 mounted on the ground tank 2. Bushing terminals 20 and 21 are provided, respectively, at upper ends of the conductors 14 and 15.

Furthermore, $SF_6$ gas of about 0.15 MPa is filled in the ground tank 2 in order to insulate the high voltage main circuit section of conductors 14 and 15 and vacuum interrupter 10, and the ground tank 2 at a ground potential or earth potential. Since the $SF_6$ gas is superior in insulating properties, the $SF_6$ gas can perform its function at a low pressure.

FIG. 5 shows a sectional view of the vacuum interrupter 10 of the earlier technology. A vacuum vessel is formed by hermetically closing both ends of a ceramic insulating tube 22 with a metallic fixed-side end plate 23 and a movable-side end plate 24. One end of the fixed lead 13 is fixed to the center of the fixed-side end plate 23. The movable lead 11 extends through a through hole **24*a* formed at the center of the movable-side end plate 24. One end of a bellows 25 is fixed to the inner side of the movable-side end plate 24 around the through hole 24*a*. The other end of bellows 25 is fixed to the movable lead 11. Fixed electrode 26 and movable electrode 27 are fixed, respectively, to inner ends of fixed lead 13 and movable lead 11 so that the fixed electrode 26 and movable electrode 27 confront each other. A main shield 28 is provided on the inner side of insulating tube 22 at the middle in the length of insulating tube 22. Terminal shields 29 and 30 are provided on the inner sides of end plates 23 and 24, respectively. A bellows shield 31 is fixed to the movable lead 11 so as to cover a part of bellows 25**.

In the thus-constructed vacuum circuit breaker, closing and opening operations are performed in the following manner. When the operating mechanism is driven in response to a closing command in the case of the closing operation, the movable lead 11 is moved through the lever and the insulating operating rod 12, and the movable lead 11 brings the movable electrode 27 into contact with fixed electrode 26, and thereby makes connection between conductors 14 and 15. When, in the case of the opening operation, the insulating operating rod 12 is pulled by the operating mechanism through the lever in response to an extracting command, the movable lead 11 is moved, and the movable lead 11 separates the movable electrode 27 from fixed electrode 26, and thereby breaks the connection between conductors 14 and 15.

In the vacuum interrupter 10, the bellows 25 capable of expanding and contracting maintains the vacuum in the vacuum vessel notwithstanding movement of the movable lead 11 in the closing and opening operations. Bellows 25 has a structure capable of bearing a pressure difference to some extent between the vacuum on the outer side and the pressure of the $SF_6$ gas on the inner side. However, when the pressure difference increases beyond a certain level, the bellows 25 may suffer phenomenon called buckling since bellow 25 is made of thin sheet of metallic material such as stainless steel. Accordingly, the pressure of the $SF_6$ gas on the inner side of bellows 25 needs to be lower than or equal to about 0.2 MPa. Moreover, for prevention of the global warming, it is required recently to reduce the quantity of usage of the $SF_6$ gas as much as possible because of its higher global warming potential.

A patent document 1 shows a technique to prevent damage of a bellows by decreasing the difference between the inner and outer pressures of the bellows by the setting of a vacuum on the outer side of the bellow and a low pressure gas or an atmospheric pressure on the inner side of the bellows. A patent document 2 shows a technique of making a space on an anti-vacuum side a sealed gastight chamber of a low pressure.

Patent Document 1: Published Japanese Patent Application, Kokai No. 2004-220922

Patent Document 2: Published Japanese Patent Application, Kokai No. H06-208820

DISCLOSURE OF THE INVENTION

Problem to be Solved by the Invention

Dry air is effective for prevention of the global warming because of its approximately zero warming potential, and hence dry air is one conceivable candidate as a filler gas in a ground tank, substituting for the $SF_6$ gas. However, the dry air is inferior in insulating ability as compared to the conventional $SF_6$ gas. Therefore, it is necessary to improve the insulation by increasing the gas pressure to about 0.4~0.5 MPa, and the bellows of the vacuum interrupter becomes one of the weakest portions with the increase of the gas pressure. To prevent buckling of the bellows, therefore, it is necessary to separate the portion of the bellows from the other portion of a high pressure, and to set the pressure in the portion of the bellows to a low pressure or the atmospheric pressure. Since the insulating performance becomes lower generally with decrease in the gas pressure, it is necessary to increase the total length of the insulating support tube and insulating operating rod which are part of the low pressure portion and which correspond to a portion defining an insulating distance between the high voltage portion and the earth portion or grounded portion. Therefore, there arises a problem that the length of the ground tank is increased as explained below with reference to FIG. 6.

In FIG. 6, a reference numeral 32 denotes a lever connecting the operating mechanism with the insulating operating rod 12, a reference numeral 33 denotes ring contacts provided between the movable lead 11 of vacuum interrupter 10 and the movable-side contact case 8, and a reference numeral 34 denotes a compression spring for pressing the movable electrode 27 onto the fixed electrode 26 and functioning to connect the insulating support tube 5 and the movable-side contact case 8 directly. Dry air is sealed at a high pressure in the ground tank 2. In this case, the pressure in the insulating support tube 5 and movable-side contact case 8 is set at the atmospheric pressure (low pressure), and the bellows 25 is arranged so that the vacuum is on the outer side of the bellows and the atmospheric pressure (low pressure) is on the inner side. Therefore, this structure can reduce the pressure difference between the outer and inner sides of the bellows 25 as the structure of the patent document 1, and thereby prevent damage of bellows 25. However, the length of the insulating support tube 5 and insulating operating rod 12 is increased to compensate for a decrease in the insulating ability. The long insulating support tube 5 and operating rod 12 causes an increase of the ground tank 2 and increases the size of the entire apparatus. When, on the other hand, the pressure in the bellows 25 is set at a high pressure, the bellows 25 should be constructed to have a structure withstanding the pressure difference between the inner and outer sides, and the cost is increased by the need for special material and special structure. In the case of the tank formed with a gas tight chamber of a low pressure on the anti-vacuum side as disclosed in the patent document 2, there is a possibility that the high pressure gas in the tank leaks gradually into the gas tight chamber, and increases the pressure gradually.

The present invention is aimed to meet such a problem, and its object is to provide a dead tank type vacuum circuit breaker to hold the stress applied to the bellows at a low level even if the pressure of the insulating to gas enclosed in the ground tank is increased so as to prevent decrease of the dielectric strength.

Means for Solving the Problem

According to one embodiment, a vacuum circuit breaker comprises: a ground tank filled with an insulating gas at a pressure higher than the atmospheric pressure; a vacuum interrupter which includes a vacuum vessel, electrodes which are supported, respectively, by a movable lead and a fixed lead in the vacuum vessel, and which are arranged so that the electrodes can be contacted with each other and separated from each other, and a bellows to retain the vacuum between the movable lead and the vacuum vessel; movable-side and fixed-side contact cases which are supported, respectively, through insulating members in the ground tank, and which are provided on both sides of the vacuum interrupter; movable-side and fixed-side conductors which are connected, respectively, with the movable-side contact case and the fixed side contact case, and which are extended through bushings provided in the ground tank, to the outside; and an insulating operating rod (12) extending through the before-mentioned insulating member (7) and connecting the movable lead (11) with an operating mechanism (4) outside the ground tank. In this vacuum circuit breaker, the movable-side conductor is tubular or in the form of a pipe, there is formed a chamber which communicates with a space on an anti-vacuum side of the bellows and which is isolated from a space filled with the insulating gas in the ground tank by a sealing device or sealing means, and the chamber is communicated, through an inside cavity of the movable-side conductor, with the atmosphere.

According to another embodiment, a vacuum circuit breaker comprises: a ground tank filled with a high pressure dry air; a vacuum interrupter which includes a movable-side end portion supported by a movable-side contact case supported in the ground tank through an insulating support tube through which an insulating operating rod is inserted, and an insulating support member, and a fixed-side end portion supported by a fixed-side contact case, and which further includes a bellows provided at the movable-side end portion, and so arranged that the vacuum is on an outer circumferential side of the bellows; and a movable-side conductor which includes a lower end connected with the movable-side contact case and an upper end connected with a bushing terminal and which is surrounded by a bushing, and a fixed-side conductor which includes a lower end connected with the fixed-side contact case and an upper end connected with a bushing terminal and which is surrounded by a bushing. In this vacuum circuit breaker, the movable-side conductor is tubular or in the form of a pipe, the inside of the movable-side conductor, the inside of the support member, the inside of the movable-side contact case and the inside of the bellows of the vacuum interrupter are communicated with one another, the upper end of the movable-side conductor is opened to the atmosphere, and there is provided, between the support member and the insulating operating rod, a gas tight seal portion to hold the high pressure dry air in the insulating support tube.

In the vacuum circuit breaker according to another embodiment, there is provided a filter in a vent hole of the movable-side bushing terminal opening to the atmosphere.

EFFECT OF THE INVENTION

Because of the high pressure insulating gas enclosed in the ground tank, it is possible to secure the insulating performance even if the length of the insulating operation rod etc., is decreased, and thereby to reduce the size of the entire apparatus. Moreover, because of the arrangement in which the atmospheric pressure is applied to the anti-vacuum side of the bellows, the pressure difference between the pressure on the outer side and the pressure on the inner side of the bellows is decreased, and the bellows is protected against damage or impairment.

Because of the arrangement in which the higher pressure of the dry air is applied to the portion, such as the insulating support tube and the insulating operation rod, where the electric field is high, the vacuum circuit breaker can retain the insulating performance even if the length of the portion including these members is decreased, and hence make it possible to reduce the entire size. Moreover, the bellows is so arranged that the atmospheric pressure is applied on the inner side of the bellows while the vacuum is on the outer side of the bellows. This arrangement can decrease the pressure difference between the pressure on the outer side and the pressure on the inner side of the bellows, and protect the bellows against damage or impairment. In order to apply the atmospheric pressure in the inside of the bellows, the atmospheric pressure is further applied to the space which communicates with the inside of the bellows and which is formed by the inside of the movable-side conductor, the inside of the insulating support member and the inside of the movable-side contact case. Because these members are members to which no high field is applied and which are equal in the potential, these members do not require high insulating ability. Furthermore, the gas sealed in the ground tank is the dry air having a small global warming potential, so that the vacuum circuit breaker is helpful to the prevention of the global warming.

In one embodiment, the movable-side bushing terminal is formed with a vent hole opening into the atmosphere, and a filter is provided in the vent hole. This arrangement is effective to prevent penetration of rain water or other foreign object into the tubular movable-side conductor.

BEST MODE(S) FOR CARRYING OUT THE INVENTION

The following is explanation on one or more best modes for carrying out the present invention with reference to the drawings. FIG. 1 is an enlarged vertical sectional front view of a main portion of a dead tank type vacuum circuit breaker according to one best mode for carrying out the present invention. FIG. 2 is a vertical sectional front view of the dead tank type vacuum circuit breaker. FIG. 3 is an enlarged vertical sectional view of a part of a movable-side conductor of the dead tank type vacuum circuit breaker. In FIGS. 1 and 3, hatching indicates portions of the atmospheric pressure. In the figures, dry air is sealed, as a high pressure insulating gas, in a ground tank 2. The high pressure dry air is also filled in bushings 16 and 17. A support plate 3 is fixed at one horizontal end in the ground tank 2. A movable-side contact case 8 is supported on the inner side of support plate 3 through an insulting support tube 5 and an insulating support member 7. At the other horizontal end in ground tank 2, a fixed-side contact case 9 is supported through a support insulating member 6. A movable-side end portion of a vacuum interrupter 10 is supported on a tubular metal member 8*b* of movable-side contact case 8. A fixed-side end portion of the vacuum interrupter 10 is supported on fixed-side contact case 9. A movable lead 11 of vacuum interrupter 10 is inserted through the movable-side contact case 8 via ring contacts 33, and connected with an insulating operating rod 12 extending through the insulating support tube 5 and insulating support member 7. Between a movable-side end plate 24 of the vacuum interrupter 10 and the movable lead 11, there is provided a bellows 25 surrounded by a vacuum applied on the outer side of the bellows 25.

A reference numeral 35 denotes a movable-side conductor which is tubular or shaped in the form of a pipe. A lower end of the movable-side conductor 35 is connected with the movable-side contact case 8. A lower end of a fixed-side conductor 15 is connected with the fixed-side contact case 9. The conductors 15 and 35 extend upwards in oblique directions from the inside of ground tank 2. Conductors 15 and 35 are surrounded, respectively, by bushings 16 and 17 provided on bushing current transformers 18 and 19. Bushing terminals 20 and 21 are connected with the upper ends of conductors 15, 35. The movable-side bushing terminal 20 has a vent hole 20*a* for leading to the atmosphere, and a filter 36 is provided in this vent hole 20*a* of the movable-side bushing terminal 20.

In order to set the atmospheric pressure on the inner side of bellows 25 of vacuum interrupter 10, the atmospheric pressure is applied in a portion leading to the inner side of bellows 25 and receiving no high electric field. More concretely, the atmospheric pressure is introduced in the inside space of the movable-side conductor 35, the inside space of the insulating support member 7 and the inside space of the movable-side contact case 8. To achieve this atmospheric pressure portion, there are provided high temperature seal portions (portions for sealing at high temperatures) 37~39, as gastight seal portions, between the outer circumference of movable-side conductor 35 and a tubular portion 8*a* of the movable-side contact case 8, between the insulating support member 7 and the movable-contact case 8, and between the movable-side contact case 8 and a tubular metal member 8*b* (welded to the end plate 24) of the contact case 8. Moreover, to provide a high pressure dry air in the insulating support tube 5, there are provided rectilinear seal portions 40 and 41, as gas tight seal portions, between the insulating operating rod 12 and the support member 7 and between the insulating operating rod 12 and the through hole 3*a* of the support plate 3.

In the above-mentioned best mode, the high field portion including members, such as the insulating support tube 5 and insulating operating rod 12, receiving the application of high electric field is arranged so that the high pressure dry air is applied to the high field portion. This arrangement can ensure the insulating performance even if the lengths of these parts, and hence makes it possible to reduce the size of the ground tank 2 and to reduce the size of the vacuum circuit breaker as a whole. The bellow 25 is arranged so that the atmospheric pressure is on the inner side of bellows 25 while the vacuum is on the outer side, and the pressure difference between the inner side and the outer side of bellows 25 is reduced. Therefore, this arrangement can prevent damage or impairment of the bellows, eliminate the need for a structure for withstanding a greater pressure difference between the inner side and outer side of the bellows, and hence reduce the cost by allowing the use of a structure adequate for mass production.

Although the bellows 25, movable-side conductor 35, support member 7 and movable-side contact case 8 are arranged so that the atmospheric pressure is applied in the inside space of bellows 25, the inside space of movable-side conductor 35, the inside space of support member 7 and the inside space of movable-side contact case 8, these parts are equal in potential and free from high electric field, and therefore these parts do not require a high pressure and a high insulating performance. The dry air sealed in ground tank 2 is small in the global warming potential, and therefore the vacuum circuit breaker can add a contribution to the prevention of the global warming. Moreover, the movable-side bushing terminal 20 includes the vent hole 20*a* which communicates with the atmosphere, and which is provided with the filter 36. Therefore, the filter can prevent rain water from flowing into the inside cavity of the hollow movable-side conductor 35.

As the high pressure insulating gas for improving the dielectric strength, the above-mentioned best mode employs dry air. However, instead of the dry air, it is possible to employ SF6 gas, CF3I gas, N2 gas etc. With the use of these high pressure insulating gases, the arrangement including the atmospheric pressure chamber formed on the anti-vacuum side opposite to the vacuum side of the bellows 25 can reduce the pressure difference between the inner side and outer side of bellows 25 and reduce the level of the stress applied to bellows 25 as in the case of the dry air. Especially, the use of the SF6 gas having a great dielectric strength makes it possible to reduce the size of the ground tank 2 when the gas pressure is set at a high pressure of about 0.17~0.4 MPa. Even in the event of leakage in the high temperature seal portions 37~39, the pressure in the inside space of movable-side contact case 8 (the inside space of tubular metallic member 8*b*) is held at the atmospheric pressure, so that the bellows 25 receives no adverse influence.

EXPLANATION OF REFERENCE NUMERALS

Figure 1:
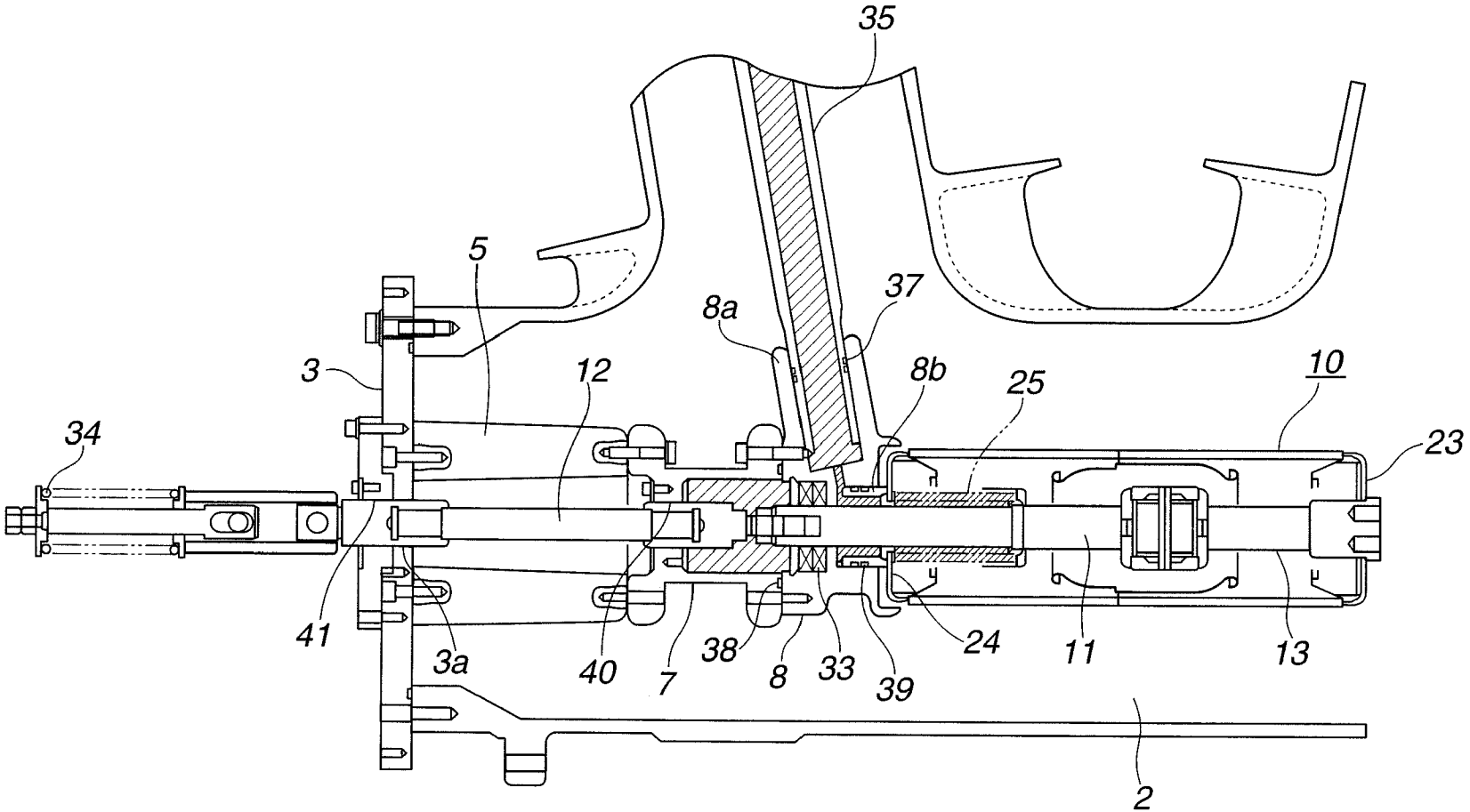
FIG. 1 is an enlarged vertical sectional front view or elevation of a main portion of a dead tank type vacuum circuit breaker according to one best mode for carrying out the present invention.
Figure 2:
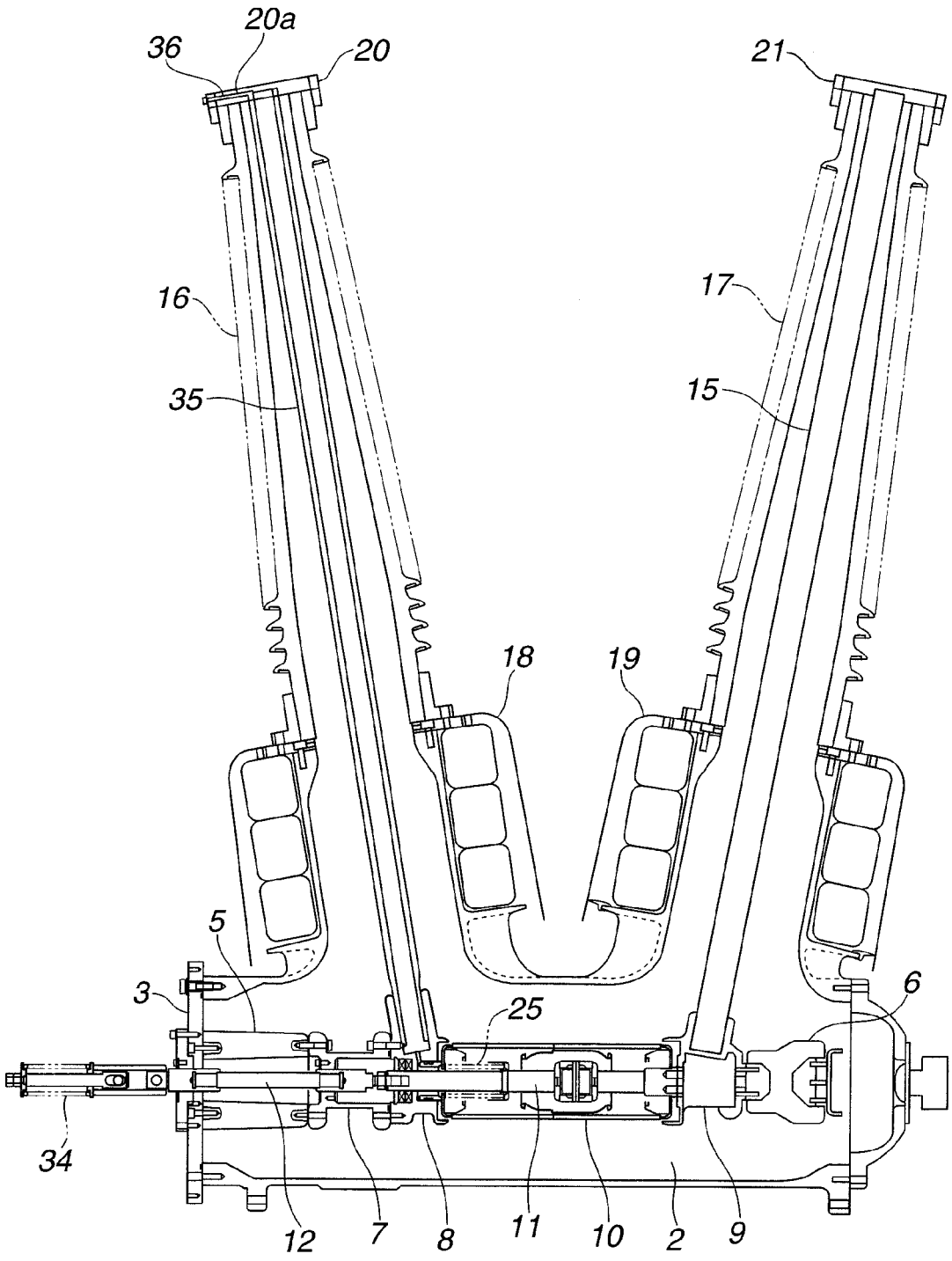
FIG. 2 is a vertical sectional front view or elevation of the dead tank type vacuum circuit breaker according to the best mode for carrying out the present invention.
Figure 3:
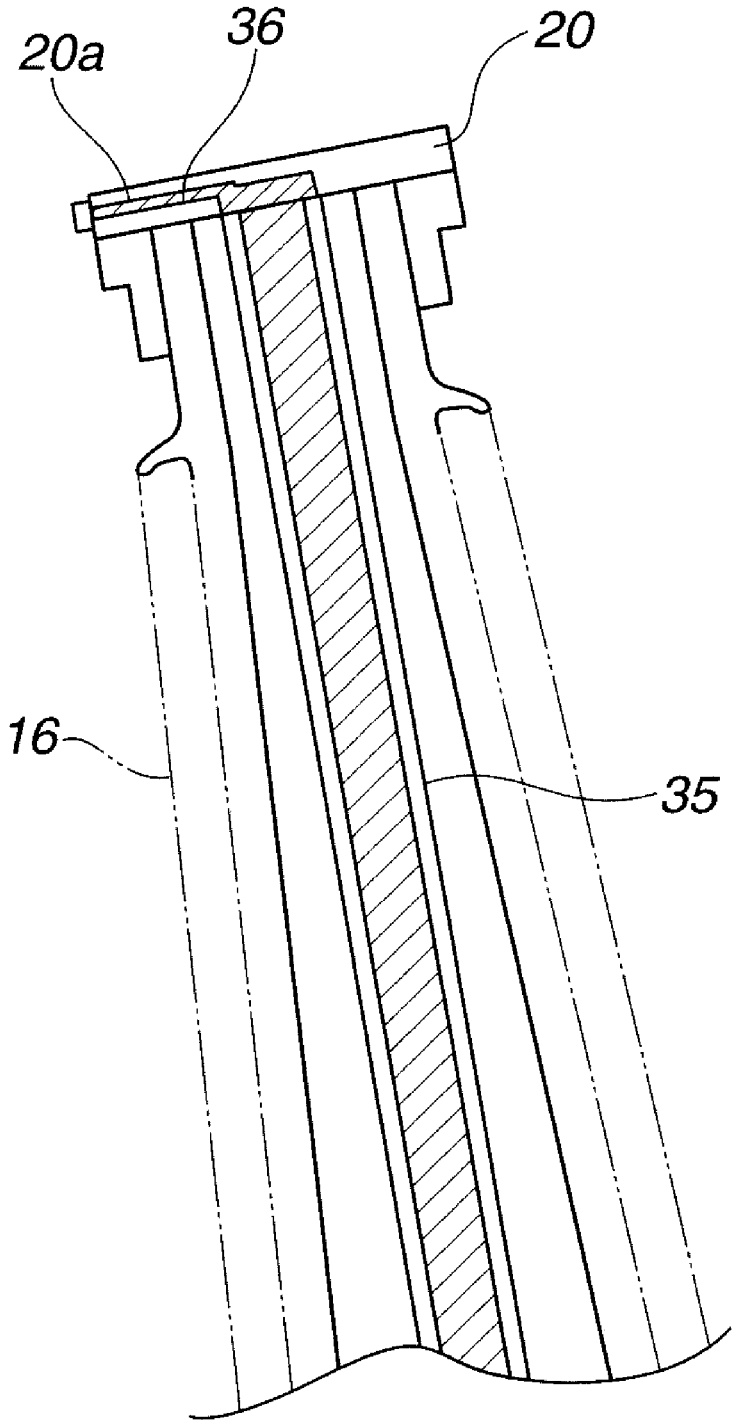
FIG. 3 is an enlarged vertical sectional view of a part of a movable-side conductor of the dead tank type vacuum circuit breaker according to the best mode for carrying out the present invention.
Figure 4:
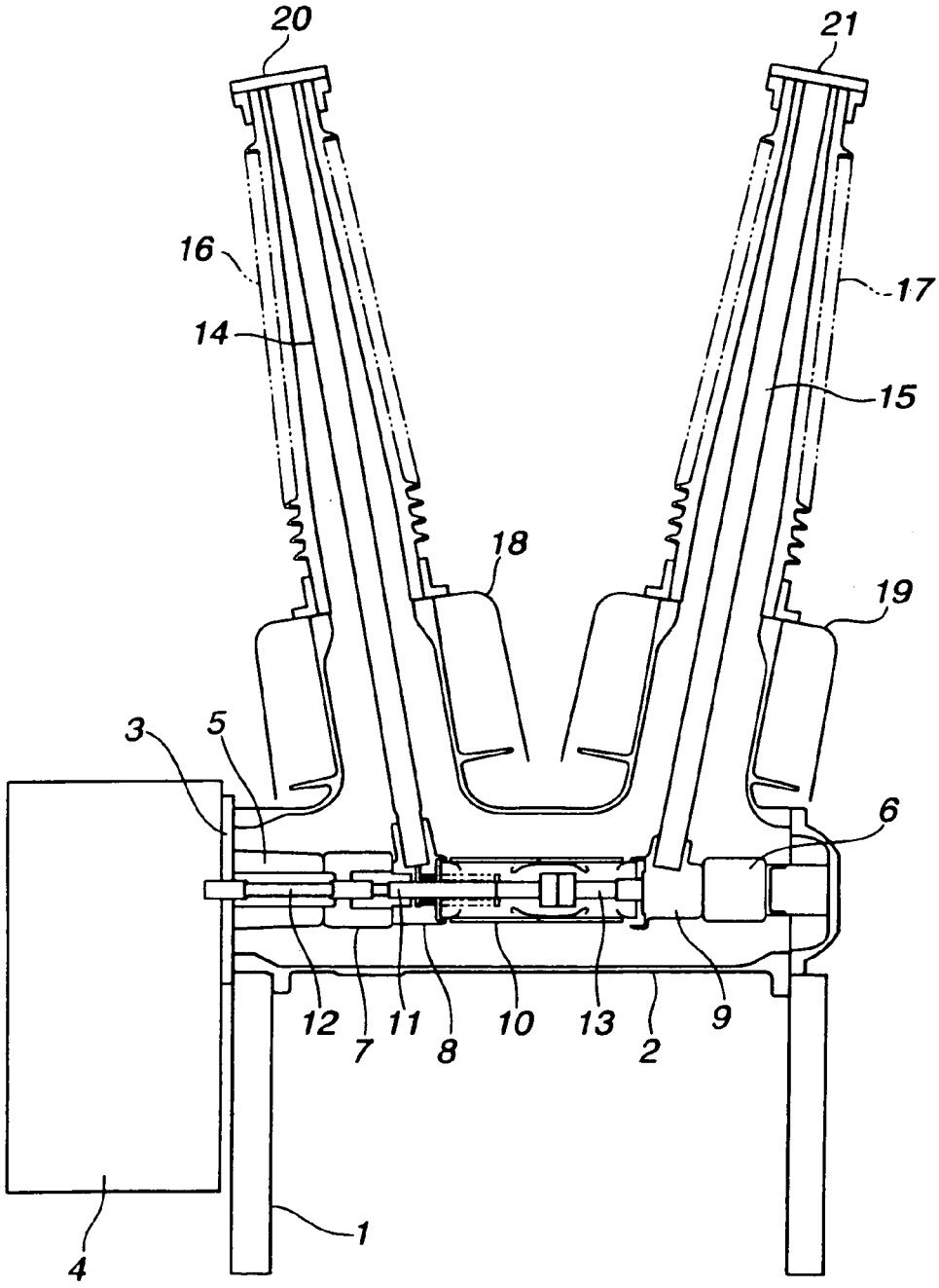
FIG.4 PRIOR ART
FIG. 4 is a vertical sectional front view of a dead tank type vacuum circuit breaker of earlier technology.
Figure 5:
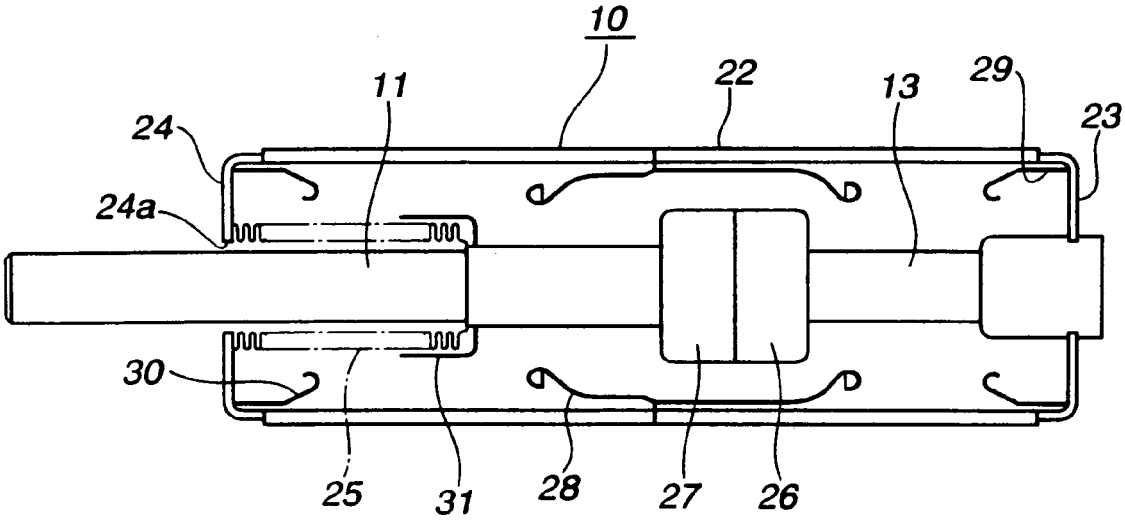
FIG.5 PRIOR ART
FIG. 5 is a sectional view of a vacuum interrupter of earlier technology.
Figure 6:
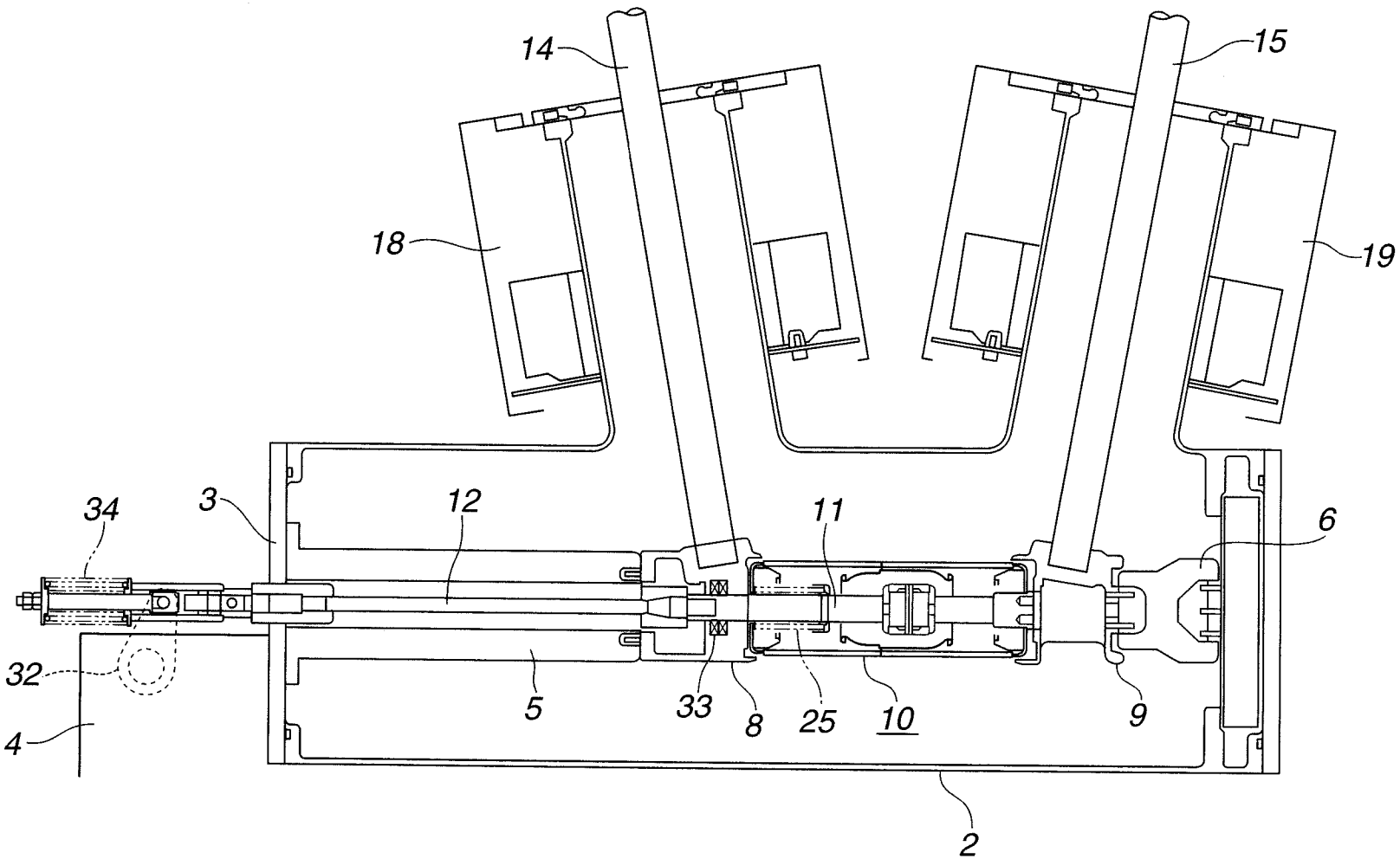
FIG. 6 is a vertical sectional front view of a dead tank type vacuum circuit breaker of earlier technology in which a dry air of a high pressure is filled in a ground tank, and the pressure is set at the atmospheric pressure in an insulating support tube, a movable-side contact case and a bellows.

2 . . . ground tank
3 . . . support plate
5 . . . insulating support tube
6 . . . support insulating member
7 . . . support member
8, 9 . . . contact cases
10 . . . vacuum interrupter
11 . . . movable lead
12 . . . insulating operating rod
13 . . . fixed lead
15, 35 . . . conductor
16, 17 . . . bushings
20, 21 . . . bushing terminals
20*a* . . . vent hole
23, 24 . . . end plates
25 . . . bellows
36 . . . filter
37~39 . . . high temperature seal portion(s)
40, 41 . . . linear seal portion(s)

The invention claimed is:

1. A vacuum circuit breaker comprising:

a ground tank configured to be filled with an insulating gas at a pressure higher than the atmospheric pressure;

a vacuum interrupter which includes:

a vacuum vessel, electrodes which are supported, respectively, by a movable lead and a fixed lead in the vacuum vessel, and which are arranged so that the electrodes can be selectively contacted with each other and separated from each other, and a bellows to retain the vacuum between the movable lead and the vacuum vessel;

a movable-side contact case and a fixed-side contact case which are supported through insulating members in the ground tank, and which are provided on both sides of the vacuum interrupter;

a movable-side conductor and a fixed-side conductor which are connected, respectively, with the movable-side contact case and the fixed side contact case, and which extend through bushings in the ground tank; and an insulating operating rod extending through one of the insulating members and connecting the movable lead with an operating mechanism, wherein the movable-side conductor is tubular and comprises an inside cavity, wherein the movable-side contact case includes a chamber which communicates with a space on a non-vacuum side of the bellows, wherein the chamber is isolated from a space configured to be filled with the insulating gas in the ground tank by a sealing device, and wherein the chamber communicates with an outside atmosphere through the inside cavity of the movable-side conductor.

2. A vacuum circuit breaker comprising:

a ground tank configured to be filled with a high pressure dry air;

an insulating support tube through which an insulating operating rod is disposed;

an insulating support member attached to the insulating support tube;

a movable-side contact case supported in the ground tank by the insulating support tube and the insulating support member;

a fixed-side contact case;

a vacuum interrupter which includes:

a movable-side end portion supported by the movable-side contact case a fixed-side end portion supported by the fixed-side contact case, and a bellows provided at the movable-side end portion, and arranged such that an outer side of the bellows is a vacuum side of the bellows;

a movable-side conductor which includes a lower end connected with the movable-side contact case and an upper end connected with a first bushing terminal, the movable-side conductor being surrounded by a first bushing, and a fixed-side conductor which includes a lower end connected with the fixed-side contact case and an upper end connected with a second bushing terminal, the fixed-side conductor being surrounded by a second bushing;

wherein the movable-side conductor is tubular, wherein an inside of the movable-side conductor, an inside of the insulating support member, an inside of the movable-side contact case and an inside of the bellows of the vacuum interrupter communicate with one another, wherein the upper end of the movable-side conductor includes a vent hole by which the inside of the movable-side conductor communicates with an outside atmosphere, and wherein a gas tight seal portion is disposed between the insulating support member and the insulating operating rod and is configured to hold the high pressure dry air in the insulating support tube.

3. The vacuum circuit breaker as claimed in claim 2, further comprising a filter disposed in the vent hole.

* * * * *